US006840737B2

(12) United States Patent
Flatman

(10) Patent No.: US 6,840,737 B2
(45) Date of Patent: Jan. 11, 2005

(54) GAS TURBINE COOLING SYSTEM

(75) Inventor: Richard J Flatman, Derby (GB)

(73) Assignee: Rolls-Royce plc, London (GB)

( * ) Notice: Subject to any disclaimer, the term of this patent is extended or adjusted under 35 U.S.C. 154(b) by 94 days.

(21) Appl. No.: 10/340,589

(22) Filed: Jan. 13, 2003

(65) Prior Publication Data

US 2003/0138320 A1 Jul. 24, 2003

(30) Foreign Application Priority Data

Jan. 17, 2002 (GB) ..... 0200992

(51) Int. Cl.[7] ..... F01D 9/06
(52) U.S. Cl. ..... 415/116; 416/97 R
(58) Field of Search ..... 415/115, 116, 415/191, 175, 176; 416/95, 96 A, 96 R, 97 R

(56) References Cited

U.S. PATENT DOCUMENTS 3,628,880 A * 12/1971 Smuland et al. ..... 415/175
3,663,118 A * 5/1972 Johnson ..... 415/116
4,126,405 A * 11/1978 Bobo et al. ..... 415/115
4,257,734 A * 3/1981 Guy et al. ..... 415/115
5,167,486 A 12/1992 Detanne
5,224,818 A * 7/1993 Drerup et al. ..... 415/115
5,232,338 A 8/1993 De Paul

FOREIGN PATENT DOCUMENTS

GB 2189845 A 11/1987

* cited by examiner

*Primary Examiner*—Edward K. Look
*Assistant Examiner*—Richard A. Edgar
(74) *Attorney, Agent, or Firm*—W. Warren Taltavull; Manelli, Denison & Selter PLLC

(57) ABSTRACT

A stage of guide vanes (20) are cooled by compressor air delivered via piping (36,38) and by leakage air in the space volume (28) bounded by the combustion apparatus (14) and turbine shafting. The leakage air is drawn through tubing (40) by the compressor air which is directed over the exit ends of tubing (40) to create the necessary pressure drop in the tubing (40).

6 Claims, 2 Drawing Sheets

GAS TURBINE COOLING SYSTEM

FIELD OF THE INVENTION

The present invention relates to the cooling system of a gas turbine engine.

BACKGROUND OF THE INVENTION

Some gas turbine engines operate at temperatures which are such as to require that at least some parts of its turbine apparatus be provided with appropriate supplies of cooling air from the engine compressor. However, air taken from the compressor for turbine cooling reduces the amount available for burning in the combustion system, thus generating an engine performance penalty. That situation is further exacerbated in that the air lost to the combustion system through cooling needs, adds to air lost through unavoidable leakage thereof through seals between the static and rotating members that make up the compressor assembly, the leaked air passing into the space volume bounded by the combustion apparatus and turbine shafts.

SUMMARY OF THE INVENTION

The present invention seeks to provide a gas turbine engine with an improved cooling mode.

The present invention comprises a gas turbine engine including a stage of turbine guide vanes, each of which has a passage therethrough, the radially inner end of said passage, with respect to the engine axis, having a respective tubular member in nested spaced relationship therein, all said tubular members being in airflow communication with a space volume bounded by combustion apparatus and turbine shafts of said engine, and suction means connected to draw air from said space volume via said tubular members, and force said drawn air through said guide vanes.

BRIEF DESCRIPTION OF THE DRAWINGS

The invention will now be described by way of example and with reference to the accompanying drawings in which.

DETAILED DESCRIPTION OF THE INVENTION

Figure 1:
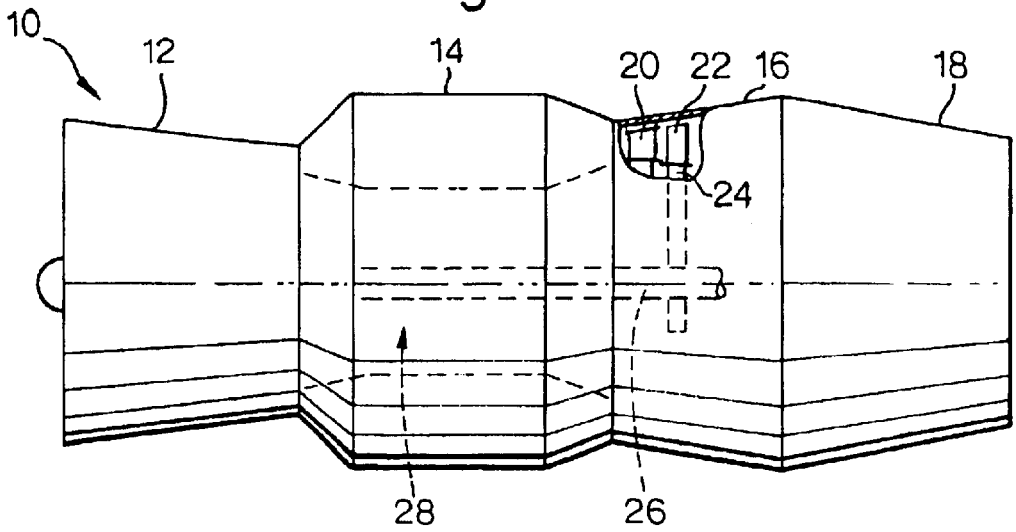
FIG. 1 is a diagrammatic sketch of a gas turbine engine of the kind which may incorporate cooling air delivery apparatus is accordance with the present invention.

Referring to FIG. 1, a gas turbine engine indicated generally by arrow 10, has a compressor 12, combustion apparatus 14, a turbine section 16 and an exhaust nozzle 18.

Turbine section 16 includes a stage of guide vanes 20, immediately followed in a downstream direction by a stage of turbine blades 22. The stage of turbine blades 22 is carried on a disk 24 in known manner. Disk 24 co-rotates with a connected shaft 26. The combustion apparatus 14, with shaft 26, bound a space volume 28 that is full of air during operation of engine 10, which air continuously leaks through seals (not shown) between the static and rotating parts (not shown) of compressor 12.

Figure 2:
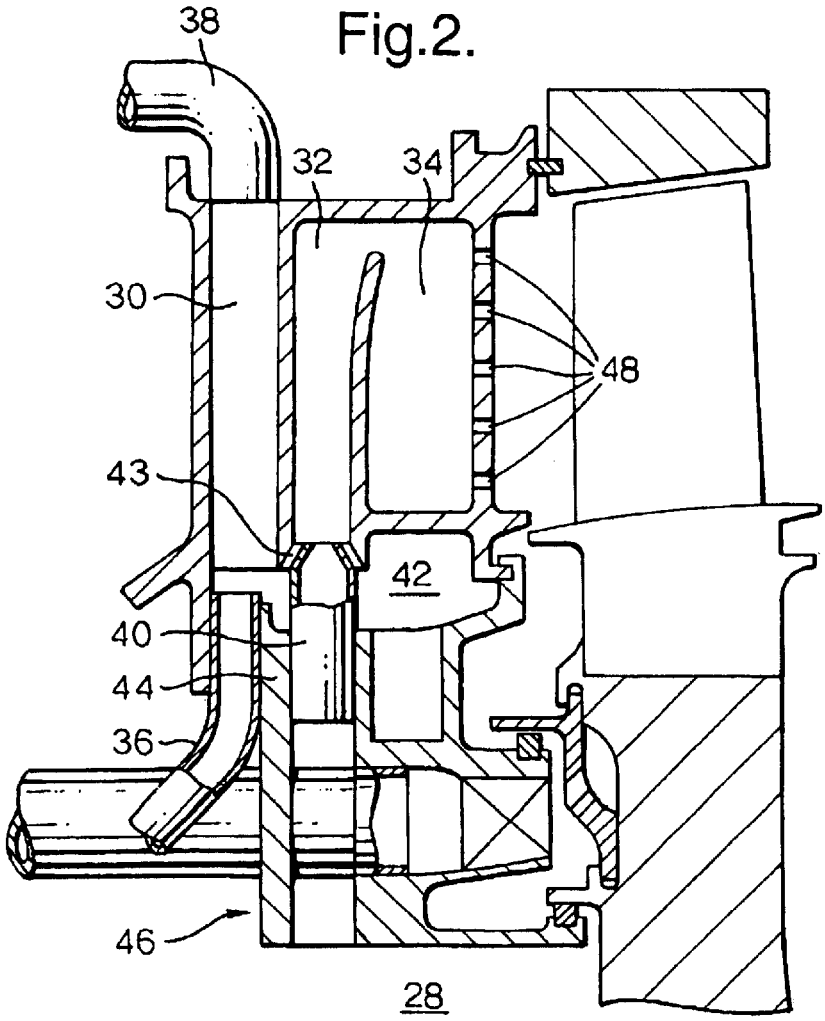
FIG. 2 is an enlarged part view of the turbine apparatus of FIG. 1 including cooling air delivery apparatus in accordance with the present invention.

Referring now to FIG. 2, in the present example the interior of each guide vane 20 is divided into three compartments numbered 30, 32 and 34 respectively. Compartment 30 is connected via piping 36 and 38, to compressor 12 (FIG. 1) for direct delivery of cooling air therein. The two opposing flows meet at the exit of pipe 36 and expand laterally around the exit end portion of a tubular member 40 into chamber 42 and into compartment 32 via a converging space 43 defined between tubular member 40 and the walls defining compartment 32.

Each tubular member 40 is located in the rim 44 or an otherwise hollow annular member 46, the radially inner portion of which is open to the space volume 28, and thereby to air that has leaked into space volume 28 during operation of engine 10. By this means, the compressor air flowing over the converging space 43 around the exit end of tubular members 40 creates a pressure drop within the exit ends which result in the initiation of a flow of leakage air from space volume 28, through tubular members 40 into respective guide vanes 20. The resulting mixture of compressor air and leakage air then flows into compartment 34, and from there via slots 48 in the trailing edges of the guide vanes 20 into the gas annulus of turbine section 16.

Figure 3:
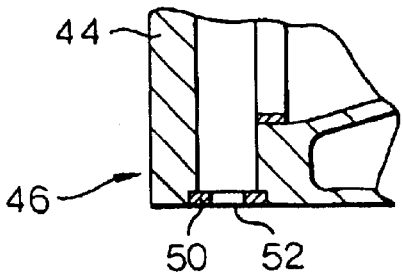
FIG. 3 is an alternative form of cooling air entry structure into the tubular members.

Referring now to FIG. 3, should it prove necessary to modify the relative pressures of the compressor air and leakage air in order to effect the desired flow of leakage air through tubular members 40, a metering plate 50 may be utilised at the radially inner end 46 of annular member 44. Metering plate 50 has a number of holes drilled in it so as to provide an appropriate flow restriction area having regard to the air flow requirements for a particular engine 10.

Figure 4:
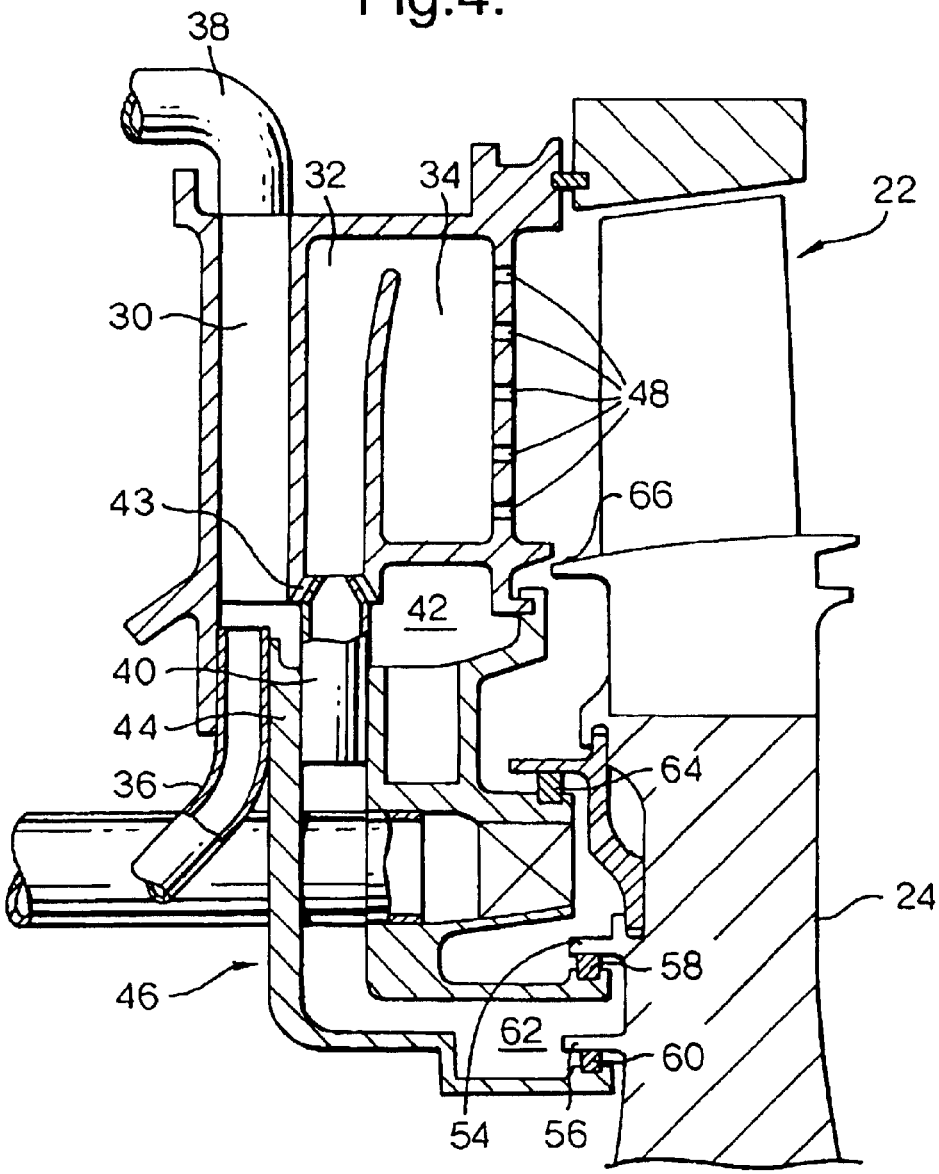
FIG. 4 is a further alternative form of cooling entry structure into the tubular structures.

Referring now to FIG. 4, this example of the present invention only differs from the example of FIG. 2 in that the radially inner end of annular member 46 is curved towards the upstream face of the adjacent turbine disk 24, and each wall of member 46 locates in radially spaced relationship within respective lands 54 and 56 formed on turbine disk 24. The radial spaces are filled by annular seals 58 and 60 supported on the curved end portions of annular member 46. An annular chamber 62 is thus formed.

During operation of engine 10 compressor leakage air in space volume 28 enters chamber 62 via seal 60. However, compressor air flowing through converging space 43 sucks the air from chamber 62 and passes it through the guide vanes exactly as described with reference to FIG. 2.

The present invention provides two advantages over and above prior art. One advantage which is attained by all three variants described and illustrated in this specification is that utilisation of compressor leakage air for the cooling of the stage of guide vanes 20, enables a reduction of up to 20% of the amount of cooling air hitherto extracted directly from the compressor for that purpose. The further advantage relates only to FIG. 4 described and illustrate herein. Leakage air is contaminated with particulate matter from the ambient atmosphere, and prior to the provision of chamber 62, it leaked past existing seal 58 into the cooling air passages ways (not shown) in the turbine blades 22 which resulted in their blockage. The leakage air also leaked past existing seal 64 and thence through the spaced overlap 66 between the vane and blade stages, thus disturbing the gas flow. Removal of the leakage air from chamber 62 by the suction means of the present invention as described hereinbefore obviated both blockage and flow disturbance.

What is claimed is:

1. A gas turbine engine including a stage of turbine guide vanes each of which has a passage therethrough, the radially inner end of said passage with respect to the engine axis, having a respective tubular member in nested, spaced relationship therein, each said tubular member being in airflow communication with a space volume bounded by combustion apparatus and turbine shafts of said engine and suction means connected to draw air from said space volume via said tubular members and force said drawn air through said guide vanes wherein said suction means comprises air feed piping connecting a compressor of said engine to said space separating each said nested tubular member from the wall of its associated passage whereby in operation there is provided a flow of pressurized air over each said tubular member into said associated passage so as to cause a sufficient pressure differential between the opposing ends of each tubular member, as to promote a flow of leakage air therethrough from said space volume into their respective passages.

2. A gas turbine engine including a stage of turbine guide vanes as claimed in claim 1 wherein each said tubular member is in direct flow connection with said space volume.

3. A gas turbine engine including a stage of turbine guide vanes as claimed in claim 1 wherein each said tubular member is in indirect flow connection with said space volume.

4. A gas turbine engine including a stage of turbine guide vanes as claimed in claim 3 wherein each said tubular member is in flow connection with said space volume via a chamber into which leakage air in said space volume leaks via seal members.

5. A gas turbine engine including a stage of turbine guide vanes as claimed in claim 1 wherein said tubular members are supported in the rim of a hollow annular member and project radially outwardly therefrom.

6. A gas turbine engine including a stage of turbine guide vanes wherein each said tubular member is in indirect flow connection with said space volume as claimed in claim 5 wherein said hollow annular member comprises a rim, the opposing faces of which extend radially inwards in the form of flanges, the radially inward portions of which are curved so as to parallel the axis of said annular member and with the face of a turbine disk of said engine, enable the forming of said chamber.

* * * * *